252-95 AU 165 EX
5/11/76 OR 3,956,156

United States Patent [19]
Osband et al.
[11] 3,956,156
[45] May 11, 1976

[54] CLEANSING OF FABRICS

[75] Inventors: Arthur Norman Osband, New Brunswick; Frederick William Gray, Summit; Jon C. Jervert, Piscataway, all of N.J.

[73] Assignee: Colgate-Palmolive Company, New York, N.Y.

[22] Filed: Apr. 28, 1971

[21] Appl. No.: 138,375

[52] U.S. Cl. ..... 252/95; 252/99; 8/111

[51] Int. Cl.[2] ..... C11D 3/395; C11D 7/54

[58] Field of Search ..... 252/95, 99, 182; 8/111

[56] References Cited

UNITED STATES PATENTS

| | | | |
|---|---|---|---|
| 3,235,505 | 2/1966 | Tuvell | 252/99 UX |
| 3,630,921 | 12/1971 | Disch et al. | 252/95 |
| 3,640,874 | 2/1972 | Gray | 252/95 |

FOREIGN PATENTS OR APPLICATIONS

| | | | |
|---|---|---|---|
| 844,481 | 6/1970 | Canada | 252/95 |

*Primary Examiner*—Mayer Weinblatt
*Attorney, Agent, or Firm*—Steven J. Baron; Murray M. Grill; Herbert S. Sylvester

[57] ABSTRACT

Use of sodium citrate in conjunction with peroxygen compounds and activators therefor.

7 Claims, No Drawings

S/A

CLEANSING OF FABRICS

The invention relates to the cleaning of fabrics (e.g. the bleaching thereof and removal of stains therefrom) with mixtures of peroxygen compounds and activators which are peracid precursors. Activators of this type are well known in the art. They are described, for instance, in a series of articles by Gilbert in Detergent Age, June 1967 p. 18–20, July 1967 p. 30–33, August 1967 p. 26, 27 and 67, which explains that such compounds include esters, anhydrides and amides. A listing of some of the commonly known activators is also found in the U.S. patent to Woods U.S. Pat. No. 3,632,634. Other disclosures of suitable activators are found in Canadian patent No. 844,481 which describes such amides (N-acyl compounds) as the N-acyl azoles; U.S. Pat. No. 3,061,550 which describes certain acylated imides; British patent No. 907,376 describing certain N-diacyl compounds such as tetraacetyl ethylenediamine, tetraacetyl methylenediamine, etc.; published Swedish patent application No. 17880/68 describing acylated glycolurils such as tetraacetylglycoluril; and French patent No. 1,590,335, describing N-acyl compounds having a m-chlorobenzoyl acyl group.

In accordance with one aspect of this invention it is found that the use of sodium citrate in conjunction with such activators and peroxygen compounds yields unexpectedly superior results, giving improved overall cleaning power.

The invention is illustrated by the following Examples. In these Examples, and in the rest of application as well, all proportions are by weight unless otherwise indicated.

EXAMPLE 1 a. A mixture of 0.11g of sodium percarbonate (of 13% active oxygen content), 0.124g of an activator, namely, N-acetyl-2-methylimidazole and 0.20 g of trisodium citrate dihydrate is added to 1 liter of distilled water (at 120°F.) in which has been dissolved an amount of calcium chloride sufficient to provide a hardness of 100 ppm calculated as calcium carbonate (i.e. 40 ppm of $Ca^{++}$ ion). The amount of the activator is about one mol per mol of active oxygen. The resulting solution is placed along with three 3 × 6 inch coffee-tea stained cotton fabric swatches of predetermined reflectance (Rd) values, in a vessel (a Tergotometer) with 100 rpm agitation for 15 minutes while the temperature is maintained at 120°F. The swatches are then rinsed and dried and the Rd values again recorded on a Gardner Color Difference Meter and the average Δ Rd value is determined.

b. A similar test is made with an identical composition except that the sodium citrate is replaced by 0.60 g of anhydrous pentasodium tripolyphosphate (TPP).

The following results are obtained:

| | Δ Rd | Solution pH at end of washing |
|---|---|---|
| with citrate | 8.2 | 8.2 |
| with TPP | 6.6 | 8.2 |

The activator designated as N-acetyl 2-methylimidazole in the foregoing Example is prepared as follows: To 8.2 g (0.1 mol) of 2-methylimidazole (a pale yellow solid of 99% purity, 143°–144°C melting point) in 67.5 g of acetone there is introduced over a one hour period a slightly greater than equimolar quantity of gaseous ketene (generated from acetone by means of a conventional ketene lamp) while the reaction mixture is maintained at a temperature of 25° to 50°C. The resulting clear solution is evaporated to dryness, yielding 12 g of a slightly yellow solid product of melting point 41°–42°C. Further details concerning the characteristics of this activator are given in the copending application of Frederick W. Gray entitled "Activators", filed on even date herewith, whose disclosure is incorporated by reference.

EXAMPLE 2

Compositions are tested for their effectiveness in bleaching cloth, on overnight soaking. In each test one gram of the composition is dissolved in one liter of water at 105°F and three coffee-tea stained cotton fabric test swatches, of predetermined reflectance (Rd) values are added. The water is distilled water in which there has been dissolved calcium chloride in the same concentration as in Example 1. After allowing to stand overnight (18 hours) without agitation at room temperature (about 75°F), the swatches are rinsed, dried and Rd values again recorded on a Gardner Color Difference Meter. The average Δ Rd value is then determined for the experiment. The following results are obtained for various compositions containing sodium perborate tetrahydrate $NaBO_3 4H_2O$), anhydrous pentasodium tripolyphosphate ("TPP"), trisodium citrate dihydrate, anhydrous sodium sulfate and activator (in this case tetraacetylglycoluril, present in amount of ⅛ mol of activator per mol of active oxygen of the perborate) as indicated:

| | (a) | (b) | (c) | (d) | (e) |
|---|---|---|---|---|---|
| Perborate | 0.20 | 0.20 | 0.20 | 0.20 | 0.20 |
| Activator | 0.05 | 0.05 | 0.05 | 0.05 | 0.05 |
| Sodium citrate | 0.20 | none | 0.10 | 0.20 | 0.30 |
| TPP | none | 0.40 | 0.40 | 0.40 | 0.40 |
| $Na_2SO_4$ | 0.65 | 0.35 | 0.25 | 0.15 | 0.05 |
| Δ Rd | 9.3 | 4.9 | 7.2 | 7.8 | 7.8 |

EXAMPLE 3

To examine the interaction between various builders and systems containing activator and peroxygen compound, there is added to a liter of water (at 105°F) in each case, 0.20 g of sodium perborate tetrahydrate, 0.05 g of the activator of Example 2 (here again the mol ratio of activator to active oxygen is 1:8) and 0.6 g of builder salt. The water is distilled water containing dissolved calcium chloride, in various amounts, to give the indicated concentrations of $Ca^{++}$ ions. Each solution is adjusted to pH10 with NaOH and allowed to stand at room temperature for 3 hours (final temperature 82°F). Half of each solution is titrated for total active oxygen by acidifying with 1 N $H_2SO_4$, treating with KI and a small amount of ammonium molybdate, and titrating with standardized thiosulfate solution using starch as the indicator. The other half of each solution is titrated for peracid by pouring over cracked ice, acidifying with glacial acetic acid, treating with KI, and titrating with standardized thiosulfate solution using starch as the indicator. The following results are obtained:

| Builder | $Ca^{++}$ conc'n (ppm) | Total Active Oxygen (mols × $10^4$ per liter) | Peracid (mols × $10^4$ per liter) |
|---|---|---|---|
| TPP | 0 | 6.63 | 0.08 |
| | 50 | 5.49 | 0.12 |
| | 100 | 4.23 | 0.10 |
| Sodium citrate | 0 | 8.45 | 2.06 |
| | 10 | 9.48 | 2.27 |
| | 50 | 9.32 | 2.27 |
| | 100 | 9.39 | 2.22 |
| Sodium carbonate | 0 | 0.54 | 0.0 |
| | 50 | 4.37 | 0.31 |
| | 100 | 5.58 | 0.84 |
| Sodium silicate | 0 | 1.81 | 0.0 |
| | 50 | 4.52 | 0.0 |
| | 100 | 5.08 | 0.0 |
| Sodium oxydiacetate (i.e. disodium diglycolate) | 0 | 0.15 | 0.0 |
| | 50 | 0.0 | 0.0 |
| | 100 | 0.0 | 0.0 |

EXAMPLE 4

The conditions of Example 2 are employed (except that the water is New Brunswick tap water) in several runs using various amounts of sodium salts of polycarboxylic acids, the amounts being such as to provide approximately equal carboxylate concentrations. The amount of sodium sulfate is such that the total weight of each composition is (as in Example 2) 1.0g. No TPP is present. The following results are obtained:

| Salt of polycarboxylate | Δ Rd |
|---|---|
| none | 5.2 |
| 0 214 g trisodium citrate | 7.4 |
| 0.251 g disodium tartrate | 5.3 |
| 0.294 g disodium succinate | 4.8 |
| 0.146 g disodium oxalate | 5.6 |

New Brunswick tap water has a hardness of about 100 ppm calculated as calcium carbonate and a copper content of less than 1 ppm. A typical chemical analysis of the New Brunswick tap water is as follows, all figures (except pH) being in parts per million, unless otherwise indicated: total hardness 90, alkalinity 38, $CO_2$ 8, pH 7.6, chlorine 1.0, iron 0.05, manganese 0.00, consumed oxygen 0.6, dissolved oxygen 15.0, chlorides 25, total solids 165, organic and volatile 40, mineral matter 125, free ammonia 0.048, albumoid ammonia 0.015, nitrites as nitrogen 0.00, nitrates as nitrogen 0.20. A typical mineral analysis of this water supply (with figures again in ppm) is: sulfates 45, silica 15, calcium 23.2, magnesium 7.776.

The invention is especially useful in the long-term presoaking of fabrics. In such soaking, unlike washing in a machine, the fabrics (clothes) and wash solution are generally substantially quiescent, there being little or no agitation of the fabrics, and the temperature may be relatively low, e.g. below 110°F for much of the soak period. Often for most of the soak period (which extends for well over an hour) the temperature is well below 100°F, e.g. 60°F, 70°F or 80°F. The conditions in soaking are such that phosphate-containing soak solutions made with peroxygen compound and activator lose practically all their peracid content during prolonged soaking (e.g. overnight). The reasons for this effect are not understood but they may result from chemical reaction between the peroxygen compound and the peracid, especially when there is present an excess of the peroxygen compound. In contrast, the wash solutions of this invention retain their peracid content for considerable periods of time and often show substantial contents of peracid after standing 18 to 20 hours at say 70° or 80° F. It will be understood that it is also within the broad scope of the invention to use higher initial temperatures for the soaking, e.g. 160°F.; such high temperature may, however, cause damage to some dyed fabrics and to some man-made fibers. The invention is also of considerable utility in the machine washing of fabrics in which the fabrics are subjected to the washing solutions for relatively short times (generally less than ½ hour and usually about 5 to 15 minutes, e.g. 10 minutes) at room temperature or at higher temperatures, such as about 120°F (about 50°C) or more, As illustrated above, the peroxygen compound may be sodium perborate or sodium percarbonate.

It is within the broader scope of the invention to use other forms of sodium perborate, e.g. sodium perborate monohydrate, or other activatable peroxy compounds; such compounds, e.g. urea-hydrogen peroxide, are well known in the art. The cation of the peroxygen compounds need not be Na; it may be, for example, K, Ca, Mg or H.

Thus far, it is preferred to use activators of the amide type, well known in the art (and discussed in the patents and publications cited above) which have a monovalent carboxylic acyl group directly attached to a nitrogen atom and which, as mentioned above, form peracids on reaction with the peroxy compound in solution. Especially suitable are compounds in which the acyl group is acetyl or benzoyl or substituted benzoyl. It is within the broader scope of this invention, however, to use other types of peracid-forming activators, e.g. esters or anhydrides, (e.g. p-sulfophenyl ethyl carbonate). The mol ratio of activator to active oxygen (of the peroxygen compound) may be varied. In the foregoing Examples ratios of about 1:1 and about 1:8 have been illustrated, but even lower ratios (e.g. 1:20 or 1:60) and higher ratios (e.g. 2:1) may be used, as well as ratios within the illustrated range (e.g. 1:2, 1:4, 1:6).

The materials of this invention are preferably employed as compositions (usually solid compositions), to be added in low concentrations (e.g. about 0.1 or 0.2%, typically 0.15% to about 0.5%) to the water to be used for washing or soaking the soiled fabrics. The proportion of peroxygen compound in the total such composition may be such that the amount of active oxygen represented by said compound is about 0.5 to 8% of the total composition. For conventional sodium perborate tetrahydrate (whose active oxygen content is usually about 10%) this amount corresponds to a range of about 5 to 80% of the perborate compound based on the total weight of the washing or soaking composition. For instance such compositions may be used in amount such as to supply a concentration of about 2 to 60 ppm (preferably about 10 to 30 ppm) of active oxygen to the wash water.

The proportion of sodium citrate in the composition may be varied. In general, more sodium citrate than activator is present. Typically the proportion of sodium citrate is in the range of about 10 to 60%, e.g. 20 or 30%, of the dry washing or soaking composition, and is such as to provide about 100 to 600 ppm of sodium citrate in the water.

Other ingredients are preferably also present in the composition. Among these are organic detergents, many of which are listed below. The proportion of organic detergent is typically in the range of about 5 to 70% (preferably about 10 to 40%) of the composition, so as to supply say about 10 to 40 ppm of detergent to the water. The following are examples of detergent-containing compositions:

EXAMPLE 5

A mixture of about 20% of sodium perborate tetrahydrate, about 10% of m-chlorobenzoyl dimethylhydantoin, about 20% sodium citrate dihydrate, about 25% of organic detergent (sodium tridecylbenzene sulfonate), about 7% of sodium silicate having an $SiO_2$:$Na_2O$ ratio of 2.4:1), about 1% of an optical brightener, up to about 5% water and the balance sodium sulfate.

EXAMPLE 6

Example 5 is repeated substituting, for the sodium tridecylbenzene sulfonate, sodium olefin sulfonate of a mixture of $\alpha$-olefins having 16 to 18 carbon atoms.

EXAMPLE 7

Example 5 is repeated substituting, for the sodium tridecylbenzene sulfonate, the sodium salt of sulfonated alkyl phenol having 18 to 20 carbon atoms in the alkyl chain and having about 1.9 sulfonate groups per alkylphenol molecule.

EXAMPLE 8

Example 5 is repeated substituting, for the sodium tridecylbenzene sulfonate, the sodium salt of the sulfate ester of a condensation product of ethylene oxide and a mixture of 12 to 15 carbon atom straight chain primary alkanols, which condensation product has about 3 ethylene oxide units per molecule.

EXAMPLE 9

Example 5 is repeated except that the detergent is a mixture of equal parts of (a)a nonionic detergent, specifically the condensation product of 11 mols of ethylene oxide with one mol of a mixture of C14 and C15 1-alkanols (Neodol 45-11). and (b)linear tridecylbenzene sulfonate.

EXAMPLE 10

Example 9 is repeated, except that the ratios of the amounts of the nonionic detergent and the sodium tridecylbenzene sulfonate is 7:18.

EXAMPLE 11

Examples 5–10 are repeated except that 15% of trisodium nitrilotriacetate is also present and the amount of organic detergent is decreased to about 12%.

In one preferred aspect of the invention the organic detergent is one whose detergent power is relatively insensitive to water hardness. (When the detergent power of this type of detergent is measured in water of various hardnesses by the conventional Spangler soil removal test described in J.A.O.C.S. Aug. 1965, 723ff, using 0.225 gram of unbuilt detergent A.I. [active ingredient] per liter of water, with no additives present, the detergent power [$\Delta$ Rd] when the waer hardness is 300 ppm is within about 20%, e.g. about 10%, of the detergent power shown when the water hardness is 100 ppm, calculated as calcium carbonate). Examples of such detergents are the nonionic detergents, the disulfonated long chain alkyl phenols (and ethers and esters thereof) and the sulfates of condensation products of ethylene oxide and long chain alkanols.

As indicated above, the compositions may contain conventional optical brighteners, soil suspending agents (such as sodium carboxymethyl cellulose or polyvinyl alcohol), as well as known builders such as phosphates (e.g. pentasodium tripolyphosphate), sodium nitrilotriacetate ("NTA"), sodium silicate, or sodium carbonate. The overall composition is preferably such that when added to water, in concentration of 0.15%, the pH of the solution is in the range of 8 to 10.

In one preferred embodiment of the invention the amount of activator is such that the proportion of the activator in the wash water is less than about 90 parts per million (e.g. about 5 to 50 ppm), and the amount of peroxygen compound is such as to provide a considerable excess (such as a 50%, 100%, 200%, 300% excess or even a 700% or greater excess) of active oxygen over that stoichiometrically equivalent to the amount of activator. In this embodiment the amount of peroxygen compound is generally within range of amounts representing about 3 to 80 parts of active oxygen per million parts of wash solution, e.g. about 10 to 40 ppm of active oxygen, based on the weight of wash solution. At the low concentrations of activator in the wash solution used in this embodiment, and in the presence of the excess of peroxygen compound (which excess may interact with the peracid formed from the activator), the advantages of the use of citrate are particularly marked.

In some cases either the activator or peroxygen compound or both may be suitably encapsulated (e.g. by means of a polymeric coating) to improve the storage stability of the composition with respect to moisture and other influences.

It is within the broader scope of this invention to use other salts of citric acid, or the acid itself (with proper adjustment of pH, e.g. to the range of about 8 to 10) in place of trisodium citrate. Examples of these are alkali metal and alkaline earth metal citrates, e.g. K, Mg or Ca citrates. For use with soft water particularly, calcium citrate is desirable.

Typical anionic detergents are the alkylbenzenesulfonates having 10 – 16, e.g. 12, carbon atoms in the alkyl group particularly of the type described in U.S. Pat. No. 3,320,174, 16 May 1967 of J. Rubinfeld; the olefin sulfonates having 12 to 20, e.g. 16, carbon atoms particularly mixtures of alkenesulfonates and hydroxyalkanesulfonates obtained by reacting an alpha olefin with gaseous highly diluted $SO_3$ and hydrolyzing the resulting sultone-containing product, as by neutralizing with excess NaOH and heat treating to open the sultone ring; and the higher alkyl sulfates such as tallow alcohol sulfate. Most commonly these materials are employed as their sodium or other alkali metal salts, but ammonium or alkaline earth metal (e.g. magnesium salts) may be used. Mixtures of various anionic detergents e.g., a mixture of a sodium alkylbenzenesulfonate and a sodium olefin sulfonate may be employed.

Other anionic detergents are water-soluble soaps which may be used, alone or in combinations with other detergents. Examples of soaps are the sodium potassium, etc. salts of fatty acids such as lauric, myristic, stearic, oleic, elaidic, isostearic, palmitic, undecylenic, tridecylenic, pentadecylenic or other saturated or unsaturated fatty acid of 11 to 18 carbon atoms Soaps of dicarboxylic acids may also be used such as the soaps of dimerized linoleic acid. Soaps of such other higher molecular weight acids such as resin or tall oil acids, e.g. abietic acid, may also be employed. One specific suitable soap is the sodium soap of a mixture of tallow fatty acids and coconut oil fatty acids (e.g. in 3:1 ratio).

Suitable olefin sulfonate detergents and their preparation, are described in Rubinfeld et al U.S. Pat. Nos. 3,428,654 and 3,506,580 as well as in the references (dealing with olefin sulfonates) cited in those patents and in DiSalvo et al U.S. Pat. No. 3,420,875. Generally the olefin sulfonates also contain small amounts (e.g. 1 to 15%) of disulfonates formed during the sulfonation reaction. The olefin sulfonates may be produced from alpha-olefins, internal olefins, or 2,2-dialkylethylenes (having a vinylidene group) or from mixtures thereof as described in the aforementioned DiSalvo patent.

Another suitable anionic detergent is an alkyl phenol disulfonate such as one having an alkyl group having some 12 to 25 carbon atoms, preferably about 16 to 22 and more preferably about 18 to 20 carbon atoms. The alkyl group is preferably of the linear biodegradable type; one preferred type is produced by alkylation of a phenol with an alpha olefin (such as a linear unbranched alpha olefin) and may have a primary or a secondary alkyl group, e.g. an alkyl group attached to the benzene ring at a point one, two, three or four carbon atoms from a terminal methyl group. In one typical material about 10–15% of the alkyl groups are attached at the 2-position of the alkyl groups and the balance randomly at the 3, 4, 5, etc. positions and the alkyl group is for instance, in the ortho position with respect to the phenolic hydroxyl group; or the material may be a mixture of o-alkyl species with p-alkyl species. The alkyl phenol may be sulfonated in conventional manner in oleum (e.g. containing 15%, 20%, 25% or 50% $SO_3$) using sufficient oleum to (e.g. 1.2 to 1.5, such as 1.3, parts of 20% oleum per part of alkyl phenol) to produce a product containing in excess of 1.6, preferably above 1.8 (e.g. 1.8 to 1.9 or 1.95) $SO_3H$ groups per alkyl phenol molecule. The disulfonate may be one whose phenolic hydroxyl group is blocked, as by etherification or esterification; thus the H of the phenolic OH may be replaced by an alkyl (e.g. ethyl) or hydroxyalkoxyalkyl (e.g. $—(CH_2CH_2O)_xH$ group in which x is one or more, such as 3, 6 or 10; and the resulting alcoholic OH may be esterified to form, say, a sulfate, e.g.$—SO_3Na$).

Other suitable anionic detergents are the paraffin sulfonates, such as the reaction products of alpha olefins and bisulfites (e.g. sodium bisulfite), for instance, the primary paraffin sulfonates of about 10–20, preferably about 15 to 20 carbon atoms.

Other suitable anionic detergents are sulfates of higher alcohols, such as sodium lauryl sulfate, sodium tallow alcohol sulfate, Turkey Red Oil or other sulfated oils, or sulfates of mono- or diglycerides of fatty acids (e.g. stearic monoglyceride monosulfate), alkyl poly (ethenoxy) ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly (ethenoxy) ether sulfates such as the sulfates of the condensation products of ethylene oxide and nonyl phenol (usually having 1 to 20 oxyethylene groups per molecule preferably 2–12).

The suitable anionic detergents include also the acyl sarcosinates (e.g. sodium lauroylsarcosinate) the acyl esters (e.g. oleic acid ester) of isothionates, and acyl N-methyl taurides (e.g. potassium N-methyl lauroyl-or oleyl tauride).

The most highly preferred water soluble anionic detergent compounds are the ammonium and substituted ammonium (such as mono-, di- and triethanolamine), alkali metal (such as sodium and potassium) and alkaline earth metal (such as calcium and magnesium) salts of the higher alkyl benzene sulfonates, olefin sulfonates, paraffin sulfonates, alkyl phenol disulfonates, the higher alkyl sulfates, and the higher fatty acid monoglyceride sulfates. The particular salt will be suitably selected depending upon the particular formulation and the proportions therein.

Nonionic surface active agents include those surface active or detergent compounds which contain an organic hydrophobic group and a hydrophilic group which is a reaction product of a solubilizing group such as carboxylate, hydroxyl, amide or amine with ethylene oxide or with the polyhydration product thereof, polyethylene glycol.

As examples of nonionic surface active agents which may be used there may be noted the condensation products of alkyl phenols with ethylene oxide, e.g., the reaction product of isooctyl phenol with about 6 to 30 ethylene oxide units; condensation products of alkyl thiophenols with 10 to 15 ethylene oxide units; condensation products of higher fatty alcohols such as tridecyl alcohol with ethylene oxide; ethylene oxide addends of monoesters of hexahydric alcohols and inner ethers thereof such as sorbitan monolaurate, sorbitol monooleate and mannitan monopalmitate, and the condensation products of polypropylene glycol with ethylene oxide.

As indicated above, the compositions may contain an enzyme such as a proteolytic enzyme which is active upon protein matter and catalyzes digestion or degradation of such matter when present as in linen or fabric stain in a hydrolysis reaction. The enzymes may be effective at a pH range of say about 4–12, and may be effective even at moderately high temperatures so long as the temperature does not degrade them. Some proteolytic enzymes are effective at up to about 80°C and higher. They are also effective at ambient temperature and lower to about 10°C. Particular examples of proteolytic enzymes which may be used in the instant invention include pepsin, trypsin, chymotrypsin, papain, bromelin, colleginase, keratinase, carboxylase, amino peptidase, elastase, subtilisia and aspergillopepidase A and B. Preferred enzymes are subtilisin enzymes manufactured and cultivated from special strains of spore forming bacteria, particularly Bacillus subtilis.

Proteolytic enzymes such as Alcalase, Maxatase, Protease AP, Protease ATP 40, Protease ATP 120, Protease L-252 and Protease L-423 are among those enzymes derived from strains of spore foaming bacillus, such as Bacillus subtillis.

Different proteolytic enzymes have different degrees of effectiveness in aiding in the removal of stains from textiles and linen. Particularly preferred as stain removing enzymes are subtilisin enzymes.

Metalloproteases which contain divalent ions such as Calcium, magnesium or zinc bound to their protein chains are of interest.

The production of various proteolytic enzyme concentrates is described in the patent literature: for example in German Offenlegenschrift No. 1,800,508 and in published Dutch patent application No. 6,815,944.

Instead of, or in addition to, the proteolytic enzyme, an amylase may be present such as a bacterial amylase of the alpha type (e.g. obtained by fermentation of B. subtilis). One very suitable enzyme mixture contains both a bacterial amylase of the alpha type and an alkaline protease, preferably in proportions to supply about 100,000 to 400,000 Novo alpha-amylase units per Anson unit of said alkaline protease.

The enzyme preparation may be incorporated as a powdered salt-containing product, or as a product containing little or no salt. It may be present in the dry mixture in the form of tiny spheroidal beads containing enzyme encapsulated in solidified molten nonionic detergent and contaning say 0.1 to 3 Anson units of protease per gram of said beads, the amount thereof being such as to provide about 0.001 to 0.1 Anson units per liter of wash solution, e.g. 0.001 to 0.1 Anson unit per gram of the whole activator-containing composition.

The brighteners may be of conventional type. For instance, in the foregoing Examples the composition may contain a mixture of the following: (a) a naphthotriazole stilbene sulfonate brightener, sodium 2-sulfo-4 (2-naphtho-1,2-triazolyl) stilbene, (b) another stilbene brightener, bis (anilino diethanolamino triazinyl) stilbene disulfonic acid, (c) another stilbene brightener, sodium bis (anilino morpholino triazinyl) stilbene disulfonate, and (d) an oxazole brightener, having a 1-phenyl 2-benzoxazole ethylene structure, 2-styryl naphtha [1, 2 d] oxazole, in the relative proportions, a:b:c:d, of about 1:1:3:1.2.

Cationic surface active agents may also be included, e.g. surface active detergent compounds which contain an organic hydrophobic group and a cationic solubilizing group. Typical cationic solubilizing groups are amine and as quaternary groups.

As examples of suitable synthetic cationic detergents there may be noted the diamines such as those of the type $RNHC_2H_4NH_2$ wherein R is an alkyl group of about 12 to 22 carbon atoms such as N-2-aminoethyl stearyl amine and N-2-aminoethyl myristyl amine; amido-linked amines such as those of the type $R^1CONHC_2H_4NH_2$ wherein $R^1$ is an alkyl group of about 9 to 20 carbon atoms, such as N-2-amino ethylstearyl amide and N-amino ethyl myristyl amide; quaternary ammonium compounds wherein typically one of the groups linked to the nitrogen atom are alkyl groups which contain 1 to 3 carbon atoms, including such 1 to 3 carbon alkyl groups bearing inert substituents, such as phenyl groups, and there is present an anion such as halogen, acetate, methosulfate, etc. Typical quaternary ammonium detergents are ethyl-dimethyl-stearyl ammonium chloride, benzyl-dimethyl-stearyl ammonium chloride, benzyl-dimethyl-stearyl ammonium chloride, trimethyl stearyl ammonium chloride, trimethyl-cetyl ammonium bromide, dimethylethyl dilauryl ammonium chloride, dimethyl-propyl-myristyl ammonium chloride, and the corresponding methosulfates and acetates.

Amphoteric detergents may also be included. Examples of these are N-alkyl-beta-aminopropionic acid; N-alkyl-betaimino-dipropionic acid, and N-alkyl, N,N-dimethyl glycine; the alkyl group may be, for example, that derived from coco fatty alcohol, lauryl alcohol, myristyl alcohol (or a laurylmyristyl mixture), hydrogenated tallow alcohol, cetyl, stearyl, or blends of such alcohols. The substituted aminopropionic and iminodipropionic acids are often supplied in the sodium or other salt forms, which may likewise be used in the practice of this invention. Examples of other amphoteric detergents are the fatty imidazolines such as those made by reacting a long chain fatty acid (e.g. of 10 to 20 carbon atoms) with diethylene triamine and monohalocarboxylic acids having 2 to 6 carbon atoms, e.g. 1-coco-5-hydroxyethyl-5-carboxymethylimidazoline; betaines containing a sulfonic group instead of the carboxylic group; betaines in which the long chain substituent is joined to the carboxylic group without an intervening nitrogen atom, e.g. inner salts of 2-trimethylamino fatty acids such as 2-trimethylaminolauric acid, and compounds of any of the previously mentioned types but in which the nitrogen atom is replaced by phosphorous.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

We claim:

1. Process of removing stains from fabrics which comprises immersing said fabrics into water containing from about 0.15 to 0.5% of a composition of (a) a peroxygen compound selected from the group consisting of urea-hydrogen peroxide and sodium perborate, sodium percarbonate, and sodium perborate monohydrate and their corresponding calcium, magnesium, potassium and hydrogen salts, (b) an activator capable of forming a peracid on reaction with the peroxygen compound, the mol ratio of activator to active oxygen from the peroxygen compound being 2:1 to 1:60 and (c) 10 to 60% by weight of an alkali metal or alkaline earth metal citrate.

2. Process as in claim 1 in which the peroxygen compound is sodium perborate or percarbonate, the activator is N-acetyl-2-methylimidazole and the citrate is sodium citrate.

3. A process as in claim 1 in which the proportions are such as to supply to said water an amount of activator in the range of about 5 to 90 ppm and an amount of peroxygen compound within the range representing about 3 to 80 ppm of active oxygen and a substantial excess of active oxygen over that stoichiometrically equivalent to the amount of activator.

4. A cleaning composition for addition to water used in the cleansing of fabrics which comprises a peroxygen compound selected from the group consisting of ureahydrogen peroxide and sodium perborate, sodium percarbonate, and sodium perborate monohydrate and their corresponding calcium, magnesium, potassium and hydrogen salts and an activator capable of forming a peracid on reaction with the peroxygen compound, the mol ratio of activator to active oxygen from the peroxygen compound being 2:1 to 1:60, and 10 to 60% by weight of sodium citrate.

5. A composition as in claim 4 wherein said mol ratio is 1:1 to 1:8 and further containing an organic detergent selected from the group consisting of anionic, nonionic, cationic and amphoteric detergents.

6. A composition as in claim 5 containing about 5 to 50% of peroxygen compound, and about 5 to 50% of organic detergent.

7. A cleaning composition for addition to water used in the cleansing of fabrics which comprises a peroxygen compound selected from the group consisting of sodium, potassium, calcium, magnesium and hydrogen perborates and percarbonates; an activator capable of forming a peracid on reaction with the peroxygen compound, said activator being of the amide type having a monovalent carboxylic acyl group directly attached to a nitrogen atom, wherein the acyl group is acetyl and benzoyl or substituted benzoyl, the mol ratio of the activator to the active oxygen of the peroxygen compound being about 2:1 to about 1:60, and 10 to 60% by weight of sodium citrate; said cleaning composition exhibiting superior bleaching effects compared to similar compositions containing standard builders.

* * * * *